United States Patent [19]

Freermann

[11] Patent Number: 4,570,557

[45] Date of Patent: Feb. 18, 1986

[54] APPARATUS FOR FOLDING AND REINFORCING AN EDGE PORTION OF FABRICS

[75] Inventor: Johannes Freermann, Ochtrup, Fed. Rep. of Germany

[73] Assignee: Carl Schmale GmbH & Co. KG, Ochtrup, Fed. Rep. of Germany

[21] Appl. No.: 658,126

[22] Filed: Oct. 5, 1984

[30] Foreign Application Priority Data

Oct. 6, 1983 [DE] Fed. Rep. of Germany ..... 3336356

[51] Int. Cl.[4] ..... A41D 35/02

[52] U.S. Cl. ..... 112/147; 112/153; 112/304

[58] Field of Search ..... 112/147, 149, 153, 152, 112/136, 304

[56] References Cited

U.S. PATENT DOCUMENTS

| | | | |
|---|---|---|---|
| 2,546,831 | 3/1951 | Newell | 112/147 X |
| 3,463,482 | 8/1969 | Baron et al. | 112/147 X |
| 3,486,470 | 12/1969 | Florczak | 112/147 |
| 3,534,954 | 10/1970 | Lynch, Jr. | 112/147 X |
| 4,003,323 | 1/1977 | Crawford et al. | 112/147 X |
| 4,095,538 | 6/1978 | Rockerath et al. | 112/147 |

FOREIGN PATENT DOCUMENTS

| | | | |
|---|---|---|---|
| 1685041 | 6/1972 | Fed. Rep. of Germany | 112/147 |
| 1685037 | 6/1972 | Fed. Rep. of Germany | 112/147 |

*Primary Examiner*—H. Hampton Hunter

*Attorney, Agent, or Firm*—Karl F. Ross; Herbert Dubno

[57] ABSTRACT

An arrangement for folding and reinforcing an edge portion of a fabric includes at least two pairs of press rolls and a folding unit therebetween. The folding unit is provided with a conveyor whose upper extension projects beyond the plane along which the fabric is forwarded. Thus, the edge portion will be lifted when engaged by this conveyor while the remaining portion of the fabric is downwardly pressed by a stationary press pad. Cooperating with this conveyor is a further conveyor which has a section inwardly directed toward the edge portion so that once the edge portion is lifted by the one conveyor, the other conveyor will fold the edge portion through the inward motion.

16 Claims, 4 Drawing Figures

APPARATUS FOR FOLDING AND REINFORCING AN EDGE PORTION OF FABRICS

FIELD OF THE INVENTION

My present invention relates to an apparatus for folding and reinforcing an edge portion of a fabric in particular of a continuous fabric or fabric pieces cut out of the continuous fabric.

BACKGROUND OF THE INVENTION

German Pat. No. 16 85 037 describes an arrangement in which between two pairs of surface press rolls a folding unit is provided. The edge portion to be folded is pressed by the rolls and simultaneously transported to the associated folding unit. In this earlier system two folding units are described as having elongated and worm-shaped guides which fold the edge portion during its advance in steps, i.e. the edge portion is firstly bent or raised to an upright position and then folded.

This earlier system has, however, the drawback that the edge portion will be warped with respect to the remaining portion of the fabric when light fabrics are used due to the friction resistance within the folding areas. This is especially true when a double folding is required.

An attempt has been made in German Pat. No. 16 85 041 to avoid this drawback by providing a guiding tongue with an L-shaped rail which guides the edge portion in conveying direction. The guiding tongue cooperates with a disk having a flange portion projecting over the edge of the fabric and which is synchronously driven with the advance movement of the fabric. Consequently the edge portion bent into an upright position will be folded by the flange portion in cooperation with the L-shaped rail.

Although this principle may seem to be sound, it has been shown that upon using primarily light fabrics, the already folded edge portion will be loosened up after leaving the folding units so that such an edge portion will be pressed and reinforced by the subsequent pair of rolls in an incorrect manner.

OBJECT OF THE INVENTION

It is the object of my invention to provide an improved apparatus for folding and reinforcing an edge portion of a fabric obviating the afore-stated drawbacks.

SUMMARY OF THE INVENTION

I realize this object, according to my invention, by providing a conveyor which lifts the edge portion and cooperates with a further conveyor which engages the lifted edge portion to fold the latter accordingly. The further conveyor has a section which is directed inwardly towards the edge portion so as to cross the conveying path of the latter. Consequently, when the one conveyor lifts the edge portion, the other conveyor will gradually fold the edge portion along its advancement in conveying direction.

Through the provision of these cooperating conveyors, a continuous transport and correct guidance of the edge portion is obtained along the entire folding area so that the subsequent pair of rolls can press and reinforce the edge portion in a proper manner.

When providing an arrangement for multiple folding of the edge portion so that at least two folding units are arranged, each of which being located between adjacent pairs of rolls, the conveyor for lifting the edge portion in the first folding unit can simply be a wheel projecting beyond the plane of transport of the fabric so that the edge portion glides over the wheel, thus lifting the edge portion.

In order to guarantee a correct lifting by the wheel, particularly when an edge portion is concerned having a smooth surface, the circumference of the wheel is provided with a friction lining or with radially extending projections like teeth, cams or the like.

The conveyor (or conveyors in case several folding stations are provided) for providing the actual folding of the edge portion is a circulating belt driven by a motor. The belt which is guided around a plurality of pulleys arranged so as to guide the belt parallel to the conveying direction in the folding area has an outer surface provided with a friction lining or with projecting teeth or cams. In order to provide a guidance of the folded edge portion to the subsequent roll unit, the upper roll of the pair of superimposed rolls is provided with an annular groove so that the edge portion folded by this conveyor abuts thereagainst and is securely pressed by the roll unit while the belt of the conveyor passes through the annular groove in the upper roll.

According to a further feature of my invention the apparatus includes a still further conveyor extending along the entire folding area for supporting the transport of the fabric especially when light and unstable fabrics are concerned. This conveyor is arranged below the fabric at a distance to the edge portion and is moved in synchronism with the advance movement of the fabric. Preferably, this conveyor is also provided as a belt drive with a belt essentially of rectangular cross section whose longer sides extend perpendicularly to the plane of the conveyor path of the fabric.

For achieving a synchronous movement of all conveyors, a drive wheel is provided outside the actual conveying path of the fabric and is connected either directly or indirectly with the belts of the concerned conveyors.

BRIEF DESCRIPTION OF THE DRAWING

The above and other features of my present invention will now be described in detail with reference to the accompanying drawing in which.

SPECIFIC DESCRIPTION

Figure 1:
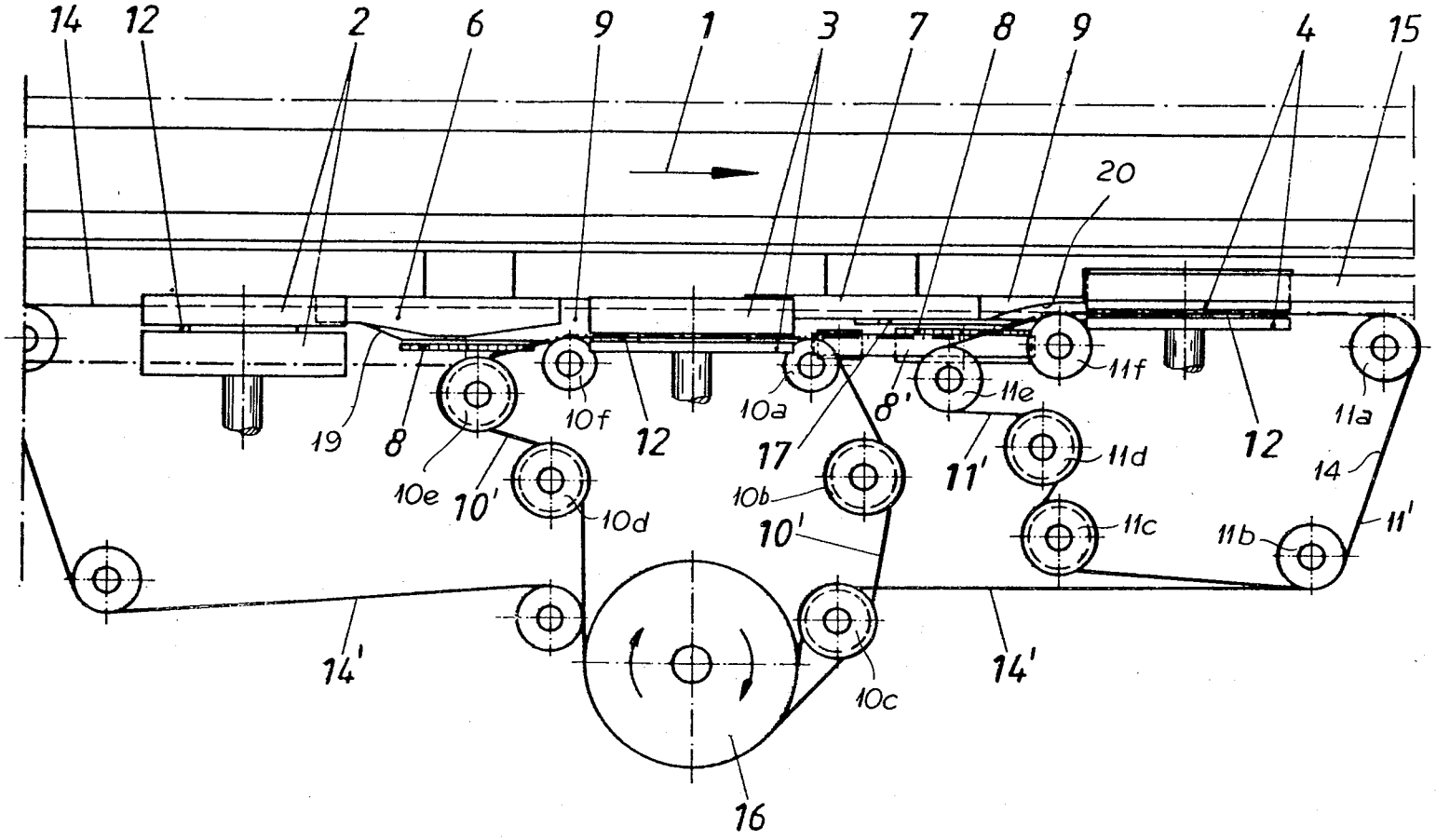
FIG. 1 is a top view of the arrangement according to the invention.

In the drawing, I have shown an arrangement for providing folded and pressed edges of a web of fabric F and including three pairs of press rolls 2, 3, 4 arranged at a certain distance to each other in direction of transport of the web of fabric F which is placed on a conveyor table whose conveying direction is generally indicated by arrow 1 (FIG. 1) and whose surface or plane is represented at 5. The two rolls of each pair of press roll 2, 3, 4 are arranged above each other in such a way that their respective circumference contact each other along the plane 5 of the conveyor. The pairs of rolls 2, 3, 4 are supported by a frame (not shown) and are driven by a motor (not shown) in a synchronous manner via respective shafts 2*a*, 2*b*; 3*a*; 3*b*; 4*a*, 4*b* which extend transversely to the conveying direction 1.

The pressure exerted by the rolls 2, 3, 4 onto the fabric F is adjustable in a conventional manner.

Arranged between the press roll pairs 2 and 3 is a first folding unit 6 and between the roll pairs 3, 4 a second folding unit 7. The unit 6 is provided with a continuous conveyor 8 which moves in synchronism with the advance of the fabric F and is constituted by a wheel with a toothed circumference.

The wheel 8 rotates in conveying direction and is arranged beneath the edge of the fabric F, wherein its upper extension projects beyond the plane 5 so that the edge portion 18 is lifted and simultaneously transported by the wheel 8. During the lifting and transport of the edge portion 18, a press pad 9 maintains the remaining portion of the fabric F on the surface 5. The press pad 9 thus extends in conveying direction over the actual fabric and has a longitudinal edge running parallel to the edge portion 18.

At its front portion facing the advancing fabric, the press pad 9 is provided with a tapered ramp 19 leading to the longitudinal edge and at its rear end with a tapered ramp 29 which leads from the longitudinal edge 21 away from the edge portion 18. Through such a provision of the press pad 9, the bending and folding as well as the conveying of the fabric is enhanced.

Cooperating with the wheel 8 is a continuous conveyor 10 driven by a belt 10'. The belt 10' is guided along a plurality of pulleys 10*a*–10*f* which are arranged slightly above the plane 5 and around a drive wheel 16. Each of the pulleys 10*a*–10*f* has a pivot shaft which extends perpendicularly to the shaft 8*a* of the wheel 8 and is also perpendicular to the plane 5. As can be seen from FIG. 1, the pulleys 10*e* and 10*f* are inwardly offset so that the belt 10' is guided inwardly towards the wheel 8 and the edge portion 18. Thus, after the wheel 8 lifts the edge portion 18, the belt 10' will gradually fold with its lower section the lifted edge portion 18 while still providing the advancement thereof.

The second folding station 7 is structured in a similar manner as the folding station 6. Accordingly, a continuous conveyor 8' is provided which has a wheel 8'' and pulleys 22, 23 around which a belt 8''' is guided. The conveyor 8' is also located at the underside of the fabric portion 18 whereby the wheel 8'' projects beyond the plane 5 so as to receive and to lift the edge portion 18 during its transport in conveying direction 1. Cooperating with the conveyor 8' is a continuous conveyor 11 which is driven by a belt 11'. The belt 11' is guided along a plurality of pulleys 11*a*–11*f* each of which has a pivot shaft arranged normal to the plane 5. The conveyor 11 extends slightly above the plane 5 so as to be able to act on the fabric edge 18 when being moved into the raised position by the wheel 8'' and to fold this edge portion 18 a second time.

In order to allow secure engagement of the conveyors 8, 8', 10, 11, with the edge portion 18, the circumference of the wheel of each conveyor 8, 8' as well as the surface of each belt 10', 11' facing the edge portion 18 is provided with a friction lining, e.g. with radially extending teeth, cam or the like. I may further note that all pairs of rolls 2, 3, 4 and all conveyors 8, 8', 10, 11 have the same conveying direction as well as the same conveying speed.

Once the fabric edge 18 has been folded by the folding stations 6 and 7, it is necessary to transport the fabric, i.e. the folded edge portion 18 in a proper manner to the subsequent press rolls 3 or 4. This is achieved by allowing the belt 10', 11' of the conveyors 10, 11 to run past the following pair of rolls 2 or 3, respectively, whereby the upper roll of each pair is provided with an annular groove 12 through which the belts 10', 11' are respectively guided. Thus, the belts 10', 11' will abut against the edge portion 18 of the fabric F and then—after folding has been provided—guides the edge portion to the subsequent pair of rolls. The edge portion is pressed by the superimposed rolls while the respective belt passes through the groove 12.

To support the transport of the fabric F along the entire folding area, a further continuous conveyor 14 is provided which runs from ahead of the first pair of rolls 2 and extends beyond the third pair of rolls 4 in the conveying direction. The conveyor 14 is driven by a belt 14' and engages the underside of the fabric F at a distance to the folding area as is illustrated in FIG. 1. The belt 14' has a rectangular profile whose longer sides are arranged perpendicularly to the plane 5 and is guided around a plurality of pulleys, some of which are also provided to guide the belts 10 or 11.

Connected to the third pair of rolls 4 is a further continuous conveyor 15 which extends almost to the press foot (not shown) of a sewing machine (not shown) and is supported by the double-folded fabric edge 18.

The drive of the individual conveyors is obtained by a drive wheel 16 which is connected to a not shown motor and is located outside the conveying path of the fabric. Thus, the drive wheel 16 is accessible and easily to be fixed to a frame (not shown). As is shown in FIG. 1 the belts 10' and 14' are guided around the drive wheel while the belt 11' is indirectly driven by the wheel 16 via the belt 14' because the belt 14' and the belt 11' are guided around common pulleys 11*f*, 11*a*, 11*b*. It is also preferred to provide the drive of the three pairs of rolls 2, 3, 4 and the continuous conveyor 15 by the same motor which drives the wheel 16 so that all conveying means are synchronized in their conveying direction and speed.

When the fabric edge has been folded in the station 6 and has been subsequently pressed by the rolls 3, it is preferred to provide the station 7 with a stationary or adjustable guide rail 17 in order to prevent a loosening of the provided fold during the subsequent further folding action. The guide rail 17 cooperates with the portion of the belt 11 extending inwardly toward the fabric edge whereby the side of the rail 17 facing the fabric F is screwshaped so that the prefolded fabric can be supported by this side over the entire folding area and preferably over its entire width during the subsequent folding.

Figure 3:
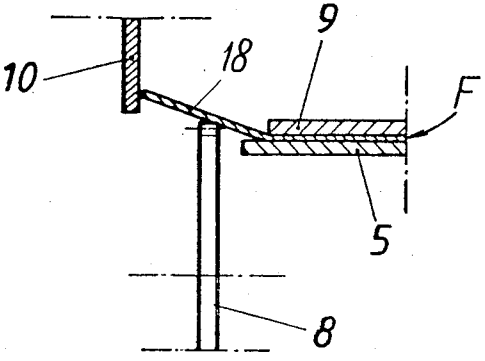
FIG. 3 is a view taken along line III—III of FIG. 2.
Figure 2:
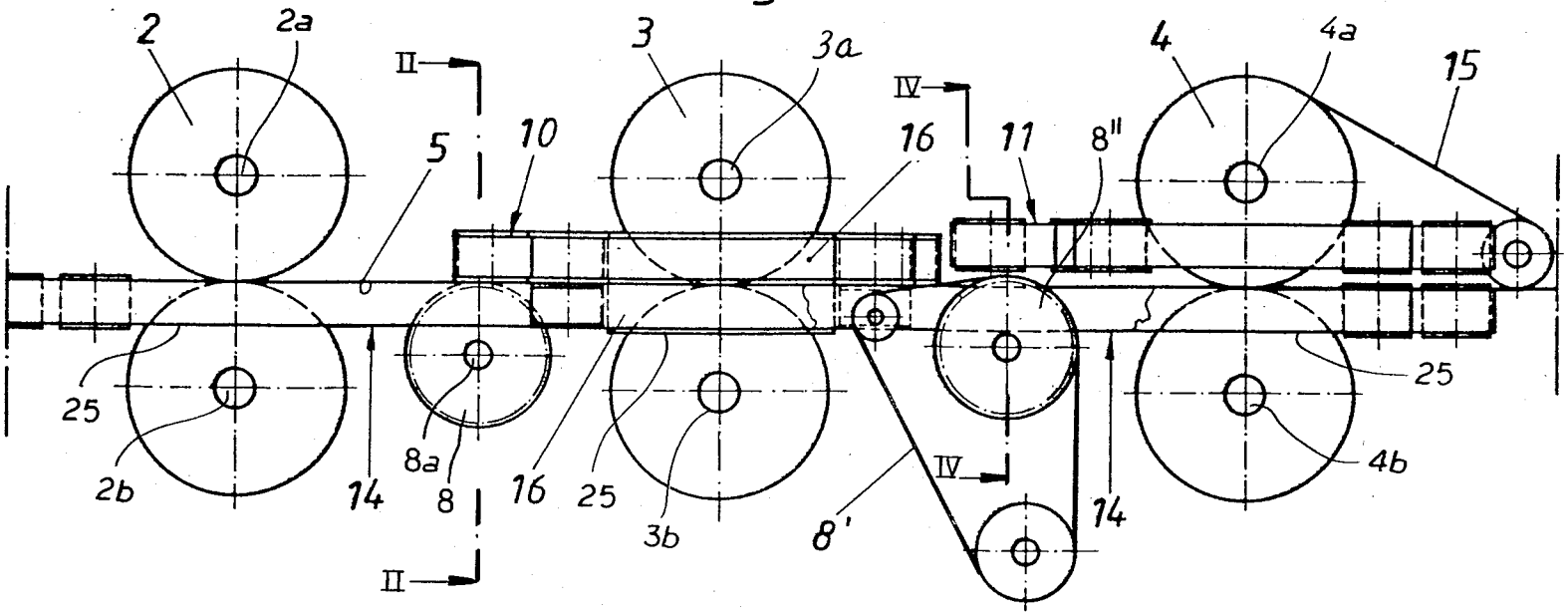
FIG. 2 is a side view of the arrangement of FIG. 1.

In order to reinforce the edge of a fabric F by folding, the fabric is placed and transported in direction of arrow 1. By means of the first pair of rolls 2, the edge will be pressed and then advanced towards the first folding station 6. When the front portion of the fabric reaches the wheel 8, the edge which is to be folded and extends parallel to the conveying direction is lifted and advanced to the conveyor 10, i.e. toward the belt 10' while the remaining portion of the fabric is kept by the press pad 9 at the level of the conveyor plane 5 (FIG. 3). The fabric edge 18 then engages with the belt 10' which, due to its inwardly directed moving path between the pulleys 10*e* and 10*f* bends and eventually folds the fabric edge 18. After passing the most inwardly located pulley 10*f*, the now folded edge is moved between the second pair of rolls 3 while still being kept in position by the belt 10' which traverses groove 12 of the upper one of the pair of rolls 3. The folded edge portion 18 is thereby pressed by the pair of rolls 3.

Figure 4:
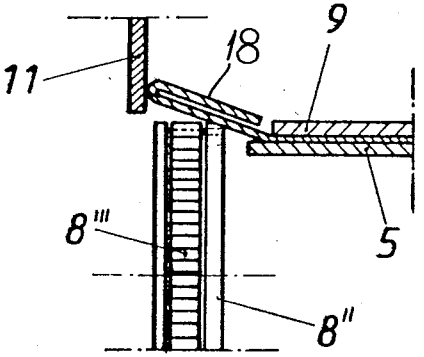
FIG. 4 is a view taken along line IV—IV of FIG. 2.

After leaving the rolls 3, the fabric edge 18 now folded once comes into contact with the conveyor 8' of the second folding station in which the fabric edge 18 folded for a second time. The conveyor 8' whose belt 8''' ascends between the pulley 22 and the wheel 8'', i.e. the upper run of the belt 8'' facing the fabric F, extends beyond the plane 5 so that the fabric edge 18 is again slightly lifted with respect to the remaining portion which is maintained at conveyor level 5 by the press pad 9 (FIG. 4). In a similar manner as described in connection with the first folding station 6, the conveyor 11 whose belt is inwardly directed towards the fabric edge 18 between the pulleys 11*e* and 11*f* will bend the advancing fabric edge 18 and eventually fold the latter for a second time with the lower belt section. A loosening of the open end of the previously provided fold is prevented by the guide rail 17 which follows the path of the belt 11' and thus keeps the folded edge in the proper position.

After having folded for a second time, the fabric edge is then forwarded between the third pair of rolls 4 to be pressed and reinforced while the belt 11' traverses the groove 12 in the upper one of the pair of rolls 4. Thus, the pressing by the rolls 4 can be performed while the fabric edge is still kept accurately in position. In this connection, I should mention that the pair of rolls 4 are located further inwardly with respect to the other pair of rolls 2 and 3 (see FIG. 1) because the width of the fabric is reduced when providing a first fold in the folding station 6. When the pressing step has been accomplished, the fabric is transported by the conveyor 15 to the press foot of a not shown sewing machine.

In this connection, I should also mention that the transport of the fabric through the individual stations and pair of rolls in a uniform manner is supported by the continuous conveyor 14. In order to allow the conveyor 14 to be adjacent to the underside of the fabric edge 18 and to prevent a lateral deflection and/or sagging, the conveyor 14 is guided through grooves 25, respectively provided at the circumference of the lower one of each pair of rolls 2, 3, 4 and is supported by the bottom of each groove 25.

Further, I would like to point out that a permanent fixation of the fold is possible, e.g. by gluing.

I claim:

1. An apparatus for folding and reinforcing an edge portion of a continuous fabric, comprising:

a first and a second roll unit for pressing the edge portion along a contact plane while simultaneously transporting the fabric, said roll units being spaced from each other in conveying direction;

a press pad arranged between said two roll units adjacent the edge portion for exerting a pressure on the remaining portion of the fabric passing thereunder so as to keep the fabric in position; and at least one folding unit arranged between said two roll units and including a first conveyor along the edge portion remote to the remaining portion of the fabric and having a section directed inwardly toward the edge portion so as to cross the conveying path of the edge portion before being pressed by said second roll unit, and a second conveyor located beneath the passing edge portion and extending beyond said contact plane, said conveyors cooperating with each other such that the edge portion is lifted by said second conveyor and then engaged by said section of said first conveyor so that the edge portion is upwardly bent and folded by the inward motion of said section of said first conveyor.

2. An apparatus as defined in claim 1 wherein said second conveyor includes a wheel rotatable around a shaft arranged perpendicularly to the conveying direction so that said wheel rotates parallel to the conveying direction.

3. An apparatus as defined in claim 2 wherein said wheel has a circumference provided with a friction lining.

4. An apparatus as defined in claim 2 wherein said wheel has a circumference provided with radially extending projections.

5. An apparatus as defined in claim 1, further comprising a third roll unit spaced from said second roll unit in conveying direction for pressing the edge portion along said contact plane; and a second folding unit arranged between said second and said third roll units and including a first conveyor arranged along the edge portion remote to the remaining portion of the fabric and having a section directed inwardly toward the edge portion so as to cross the conveying path of the edge portion of the fabric before the latter is pressed by said third roll unit, and a second conveyor located beneath the passing edge portion and extending beyond said contact plane, said conveyors of said second folding station cooperating with each other such that the edge portion is lifted by said second conveyor of said second folding unit and then engaged by said section of said first conveyor of said second folding unit so that the edge portion is upwardly bent and gradually folded a second time by the inward motion of said section of said first conveyor of said second folding unit, said first conveyors of said folding units being circulating belt drives located above said contact plane around a respective plurality of pulleys, each supported by a shaft arranged perpendicularly to the conveying direction so that one portion of said belt drive which engages the edge portion runs parallel to the conveying direction.

6. An apparatus as defined in claim 5 wherein each of said belt drives has a belt provided with a friction lining.

7. An apparatus as defined in claim 5 wherein each of said belt drives has a belt provided with radially extending projections.

8. An apparatus as defined in claim 5 wherein each of said roll units includes a pair of superposed rolls whose respective circumferences approach each other to define said contact plane, the upper one of each pair of rolls being provided with a groove for allowing said first conveyors to pass through the nip of the respective pair of rolls.

9. An apparatus as defined in claim 1 wherein said press pad has a longitudinal edge running parallel to the edge portion of the fabric, said press pad having a tapered forward portion leading to said longitudinal edge and a tapered rear portion leading from said longitudinal edge.

10. An apparatus as defined in claim 5, further comprising a further conveyor extending at least along said folding unit underneath the fabric and parallel to the conveying direction at a distance to the edge portion of the fabric, said further conveyor supporting the fabric and transporting the latter in synchronism with the forward movement of the fabric.

11. An apparatus as defined in claim 10 wherein said further conveyor is a belt drive around a plurality of pulleys, each having a shaft extending perpendicularly to the conveying direction.

12. An apparatus as defined in claim 11 wherein said belt drive includes a flat belt having an essentially rectangular cross-section whose longer sides extend perpendicularly to the conveying direction.

13. An apparatus as defined in claim 10, further comprising a drive wheel driven by a motor and being associated to said first conveyor of said first folding unit and to said further conveyor for operating the latter in a synchronous manner.

14. An apparatus as defined in claim 13 wherein at least one of said pulleys for guiding said first conveyor of said second folding unit is provided for guiding simultaneously said further conveyor so that said first conveyor of said second folding unit is indirectly driven by said drive wheel via said further conveyor.

15. An apparatus as defined in claim 13 wherein said drive wheel is arranged at a distance to the conveying direction of the fabric.

16. An apparatus as defined in claim 5 wherein said second folding unit further includes a guide rail extending parallel to the edge portion and having a portion adapted to the inward motion of said section of said first conveyor of said second folding unit.

* * * * *